US012760973B2

(12) United States Patent
Chen et al.

(10) Patent No.: US 12,760,973 B2
(45) Date of Patent: Oct. 13, 2026

(54) VAPOR CHAMBER

(71) Applicant: DELTA ELECTRONICS, INC., Taoyuan City (TW)

(72) Inventors: Wen-Shiang Chen, Taoyuan City (TW); Ting-Yuan Wu, Taoyuan City (TW)

(73) Assignee: DELTA ELECTRONICS, INC., Taoyuan City (TW)

( * ) Notice: Subject to any disclaimer, the term of this patent is extended or adjusted under 35 U.S.C. 154(b) by 137 days.

(21) Appl. No.: 18/760,027

(22) Filed: Jul. 1, 2024

(65) Prior Publication Data

US 2025/0290706 A1 Sep. 18, 2025

(30) Foreign Application Priority Data

Mar. 18, 2024 (CN) ..... 202420524665.1

(51) Int. Cl.
*F28D 15/04* (2006.01)

(52) U.S. Cl.
CPC ..... *F28D 15/046* (2013.01)

(58) Field of Classification Search
CPC ..... F28D 15/046; F28D 15/0233; F28F 3/12; H01L 23/427
See application file for complete search history.

(56) References Cited

U.S. PATENT DOCUMENTS

2022/0120509 A1* 4/2022 Takeda ..... H01L 23/427

FOREIGN PATENT DOCUMENTS

CN 206772103 U * 12/2017
TW 1690684 B * 4/2020

* cited by examiner

*Primary Examiner* — Harry E Arant
(74) *Attorney, Agent, or Firm* — CKC & Partners Co., LLC

(57) ABSTRACT

A vapor chamber includes a first plate body, a second plate body, a capillary structure, and a first thin capillary layer. The second plate body is disposed below the first plate body. The first plate body and the second plate body form a closed cavity. The capillary structure is disposed within the closed cavity. The capillary structure includes at least one column and at least one strip. The at least one strip has an opposite first surface and a second surface. The first surface faces the first plate body or the second plate body, and the at least one strip has a plurality of first grooves that are recessed from the first surface toward the second surface. The first thin capillary layer is disposed between the second plate body and the capillary structure.

19 Claims, 10 Drawing Sheets

VAPOR CHAMBER

CROSS-REFERENCE TO RELATED APPLICATION

This application claims priority to China application No. 202420524665.1 filed on Mar. 18, 2024, which is herein incorporated by reference in its entirety.

BACKGROUND

Field of Invention

The present disclosure relates to a vapor chamber. More particularly, the present disclosure relates to a vapor chamber including a strip with grooves.

Description of Related Art

In electronic products, a vapor chamber is a common heat dissipation device that is often used in the field of heat dissipation. The conventional vapor chamber is bonded to the surface of a heat source. The conventional vapor chamber has an upper plate body and a lower plate body. The upper plate body and the lower plate body are combined to form a cavity. The cavity may be filled with a working fluid. The heat source may heat the working liquid and vaporize the working liquid. The gaseous working liquid will evaporate, then release heat and condense on the side away from the heat source, and then take away the heat from the heat source to achieve the purpose of heat dissipation.

The vapor chamber is mainly composed of upper and lower plates with good thermal conductivity, which is edge-sealed and welded to form a vacuum cavity, and the interior of the cavity contains a column and strip structure connected by capillary tissue. However, the strip structure of this vapor chamber has no air holes on the sides. Therefore, effective steam conduction cannot be carried out on the side of the strip structure, resulting in excessive internal steam flow resistance and poor vacuum degassing effect.

This type of traditional capillary structure design is increasingly unable to meet the needs of use. Therefore, how to further improve the air conduction capacity based on the existing capillary structure has become the focus of research and development of various companies.

SUMMARY

In view of this, one purpose of the present disclosure is to propose a vapor chamber that may solve the above problems.

One aspect of the present disclosure is to provide a vapor chamber. The vapor chamber includes a first plate body, a second plate body, a capillary structure, and a first thin capillary layer. The second plate body is disposed below the first plate body. The first plate body and the second plate body form a closed cavity. The capillary structure is disposed within the closed cavity. The capillary structure includes at least one column and at least one strip. The at least one strip has an opposite first surface and a second surface. The first surface faces the first plate body or the second plate body, and the at least one strip has a plurality of first grooves that are recessed from the first surface toward the second surface. The first thin capillary layer is disposed between the second plate body and the capillary structure.

According to one or some embodiments, a cross-sectional profile of each first groove is a polygon, or each first groove has a curved surface.

According to one or some embodiments, the first grooves communicate with each other.

According to one or some embodiments, the at least one strip has a plurality of second grooves that are recessed from the second surface toward the first surface.

According to one or some embodiments, the second grooves communicate with each other.

According to one or some embodiments, a cross-sectional profile of each second groove is a polygon, or each second groove has a curved surface.

According to one or some embodiments, the first grooves are substantially symmetrically arranged with the second grooves.

According to one or some embodiments, the vapor chamber further includes a second thin capillary layer disposed between the first plate body and the capillary structure.

According to one or some embodiments, the first plate body has a third surface toward the capillary structure, and the third surface has a capillary feature.

According to one or some embodiments, the second plate body has a fourth surface toward the capillary structure, and the fourth surface has a capillary feature.

Another aspect of the present disclosure is to provide a vapor chamber. The vapor chamber includes a first plate body, a second plate body, a capillary structure, and a first thin capillary layer. The second plate body is disposed below the first plate body. The first plate body and the second plate body form a closed cavity. The capillary structure is disposed within the closed cavity. The capillary structure includes at least one column and at least one strip. The at least one strip has an opposite first side surface and a second side surface, the first side surface and the second side surface respectively extend along a long side of the at least one strip, and the at least one strip has a plurality of holes penetrating from the first side surface to the second side surface. The first thin capillary layer is disposed between the second plate body and the capillary structure.

According to one or some embodiments, a cross-sectional profile of the holes is a circle, a polygon, or an irregular profile.

According to one or some embodiments, the vapor chamber further includes a second thin capillary layer disposed between the first plate body and the capillary structure.

According to one or some embodiments, the first plate body has a first surface toward the capillary structure, and the first surface has a capillary feature.

According to one or some embodiments, the second plate body has a second surface toward the capillary structure, and the second surface has a capillary feature.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
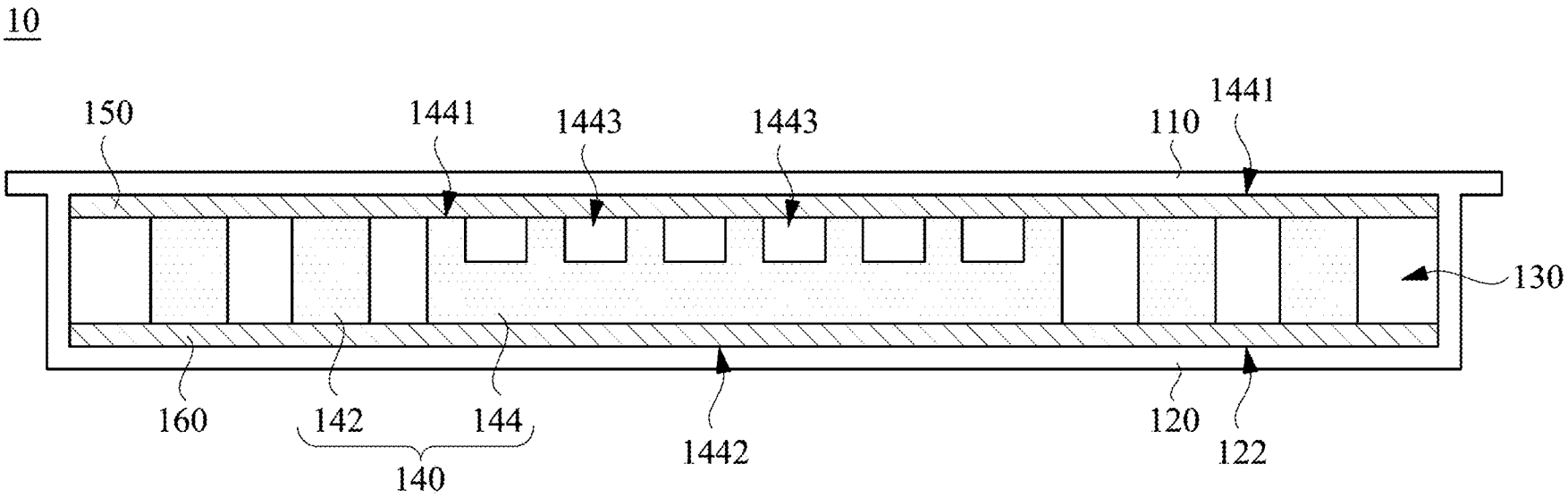
FIG. 1 is a schematic cross-sectional view of a vapor chamber according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

The vapor chamber manufacturing process is to sinter the open cavity filled with the capillary structure material of metal material at high temperature, sinter the capillary structure on the surface of the cavity, and then weld and seal the cavity with the metal cover plate or another cavity. Inject cooling working fluid (such as water or alcohol) into the cavity and vacuum treatment. When the vapor chamber is heated on one side, the working fluid stored in the pores of the capillary structure quickly vaporizes and transfers the heat to the other side of the vapor chamber. After the heat of water vapor is absorbed, the water vapor condenses into a liquid state and passes through the capillary force. The capillary structure returns to the evaporating part, so repeatedly, it depends on the gas-liquid transition of the refrigeration working fluid to achieve heat transfer and diffusion.

FIG. 1 is a schematic cross-sectional view of a vapor chamber according to an embodiment of the present disclosure. Referring to FIG. 1, the vapor chamber 10 includes a first plate body 110, a second plate body 120, a capillary structure 140, and a first thin capillary layer 150. To be specific, the second plate body 120 is disposed below the first plate body 110, and the first plate body 110 and the second plate body 120 form a closed cavity 130. The periphery of the first plate body 110 and the periphery of the second plate body 120 are connected to each other smoothly without any fixing holes or other components. In some embodiments, the material of the first plate body 110 and the second plate body 120 is pure copper or copper alloy.

In some embodiments, the first plate body 110 has a surface 112 toward the capillary structure 140, and the surface 112 has a capillary feature (not shown). That is to say, the surface 112 of the first plate body 110 has a rough surface structure, for example, a continuous uneven surface structure or a discontinuous uneven surface structure. The maximum height roughness (Rymax) of the rough surface structure ranges from several microns to several centimeters. The rough surface structure may be regarded as a capillary structure feature. The capillary structure feature is formed, for example, through mechanical processing (such as computer numerical control (CNC) milling technology, sandblasting, or stamping, etc.), chemical processing (such as electroplating or etching), or physical grinding, but the disclosure is not limited thereto.

In some embodiments, the second plate body 120 has a surface 122 toward the capillary structure 140, and the surface 122 has a capillary feature (not shown). That is to say, the surface 122 of the second plate body 120 has a rough surface structure, for example, a continuous uneven surface structure or a discontinuous uneven surface structure. The maximum height roughness (Rymax) of the rough surface structure ranges from several microns to several centimeters. The rough surface structure may be regarded as a capillary structure feature. The capillary structure feature is formed, for example, through mechanical processing (such as computer numerical control (CNC) milling technology, sandblasting, or stamping, etc.), chemical processing (such as electroplating or etching), or physical grinding, but the disclosure is not limited thereto.

Figure 2:
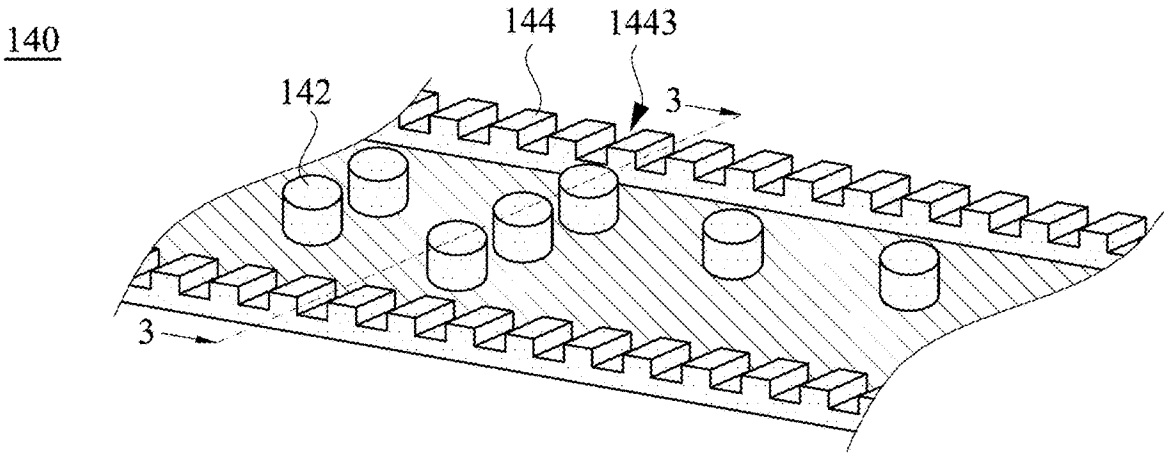
FIG. 2 is a schematic diagram of an internal capillary structure of a vapor chamber according to an embodiment of the present disclosure.

FIG. 2 is a schematic diagram of an internal capillary structure of a vapor chamber according to an embodiment of the present disclosure. Referring to FIG. 1 and FIG. 2, the capillary structure 140 is disposed within the closed cavity 130. More specifically, the capillary structure 140 is distributed on an inner surface of the first plate body 110 or the second plate body 120, in which the inner surface refers to the surface where the first plate body 110 and the second plate body 120 face each other. The capillary structure 140 includes at least one column 142 and at least one strip 144. The strip 144 has an opposite first surface 1441 and a second surface 1442, the first surface 1441 faces the first plate body 110 or the second plate body 120, and the strip 144 has a plurality of first grooves 1443 that are recessed from the first surface 1441 toward the 1442. In some embodiments, the column 142 and the strip 144 included in the capillary structure 140 are sintered using the same or similar metal powder as the first plate body 110 and the second plate body 120. In some embodiments, these first grooves 1443 may be formed on the strip 144 by etching, laser, stamping, or other suitable processes.

Please return to FIG. 1, in some embodiments, the first thin capillary layer 150 is disposed between the first plate body 110 and the capillary structure 140. The first thin capillary layer 150 may be a copper mesh microstructure or a copper fiber paper. The first thin capillary layer 150 is in direct contact with the first plate body 110 and the capillary structure 140. The first thin capillary layer 150 may connect single layer or multi-layer copper meshes to each other by diffusion bonding, and is tightly bonded with the first plate body 110. For example, the average pore diameter of the first thin capillary layer 150 may be about 50 microns to about 100 microns. In some embodiments, the first thin capillary layer 150 is disposed in the closed cavity 130 and completely covering the surface 112 of the first plate body 110.

Referring to FIG. 1, in some embodiments, the vapor chamber 10 may further include a second thin capillary layer 160 disposed between the second plate body 120 and the capillary structure 140. The second thin capillary layer 160 may be a copper mesh microstructure or a copper fiber paper. The second thin capillary layer 160 is in direct contact with the second plate body 120 and the capillary structure 140. The second thin capillary layer 160 may connect single layer or multi-layer copper meshes to each other by diffusion bonding, and is tightly bonded with the second plate body 120. For example, the average pore diameter of the second thin capillary layer 160 may be about 50 microns to about 100 microns. In some embodiments, the second thin capillary layer 160 is disposed in the closed cavity 130 and completely covering the surface 122 of the second plate body 120.

Figure 3:
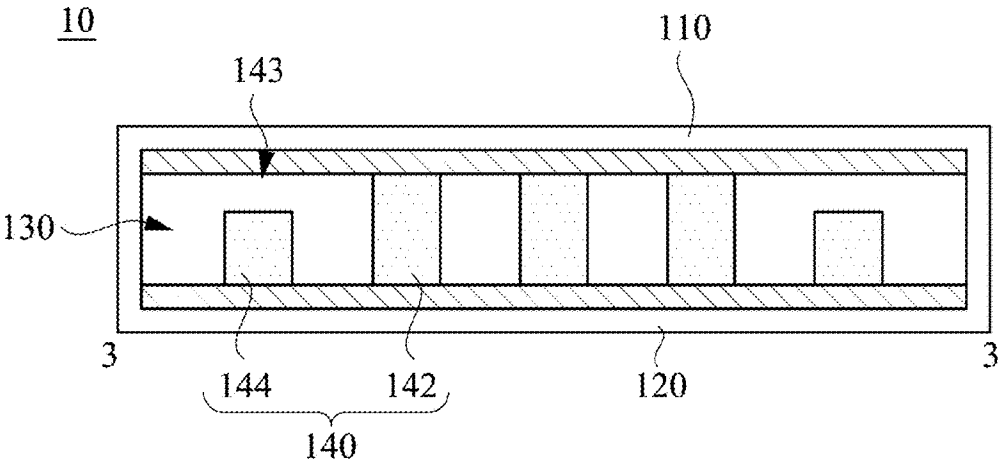
FIG. 3 is a schematic cross-sectional view of the vapor chamber according to an embodiment of the present disclosure along the line 3-3 in FIG. 2.

FIG. 3 is a schematic cross-sectional view of the vapor chamber according to an embodiment of the present disclosure along the line 3-3 in FIG. 2. Referring to FIG. 3, since the strip 144 of the present disclosure has a plurality of grooves 143, when the vapor flow is generated inside, these grooves 143 of the strip 144 provide a path for the conduction of vapor in the lateral direction, thereby further improving the gas conduction capability of the vapor chamber 10. The "lateral direction" mentioned here summarizes the direction of the long sides of all non-parallel strips 144.

Figure 4:
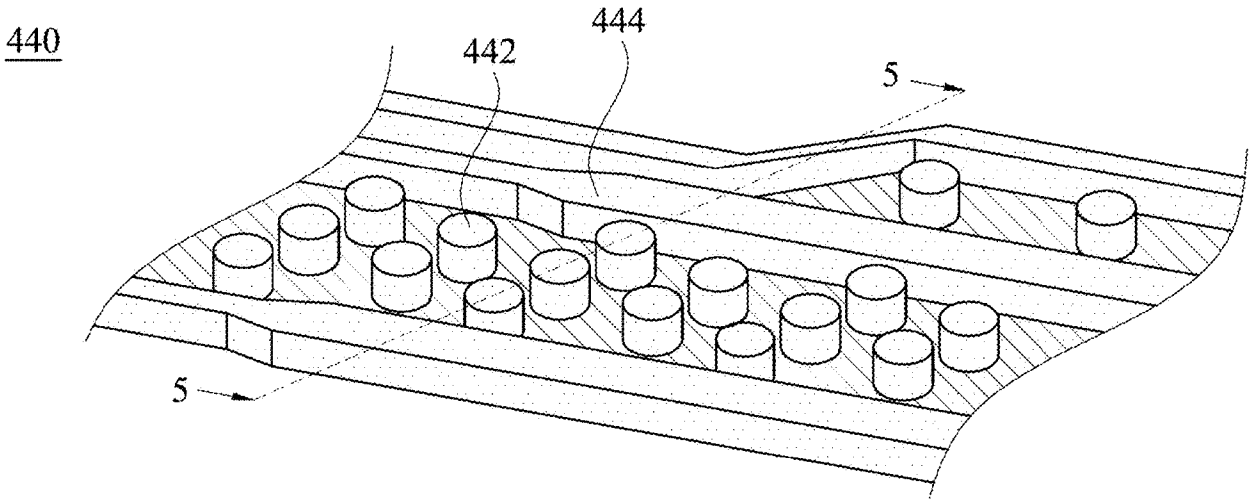
FIG. 4 is a schematic diagram of an internal capillary structure of a vapor chamber in a comparative example.
Figure 5:
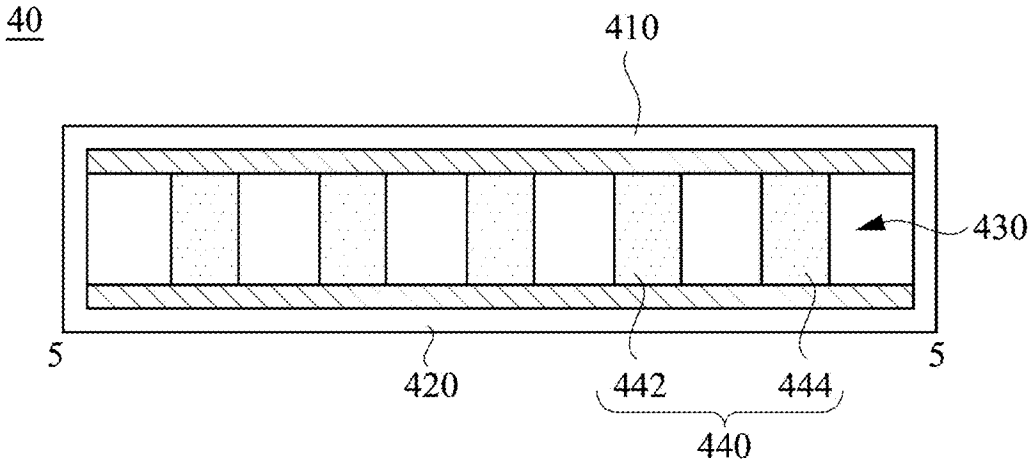
FIG. 5 is a schematic cross-sectional view of the vapor chamber of the comparative example along the line 5-5 in FIG. 4.

FIG. 4 is a schematic diagram of an internal capillary structure of a vapor chamber in a comparative example. FIG. 5 is a schematic cross-sectional view of the vapor chamber of the comparative example along the line 5-5 in FIG. 4. In contrast, the traditional capillary structure 440 design includes columns 442 and strips 444, but the strips 444 does not have any groove design. When the traditional vapor chamber 40 conducts steam, the vapor on both sides of the strips 444 may only flow along the long sides of the strips 444, resulting in a slow steam conduction rate and poor heat dissipation ability of the vapor chamber 40.

Figure 6A:
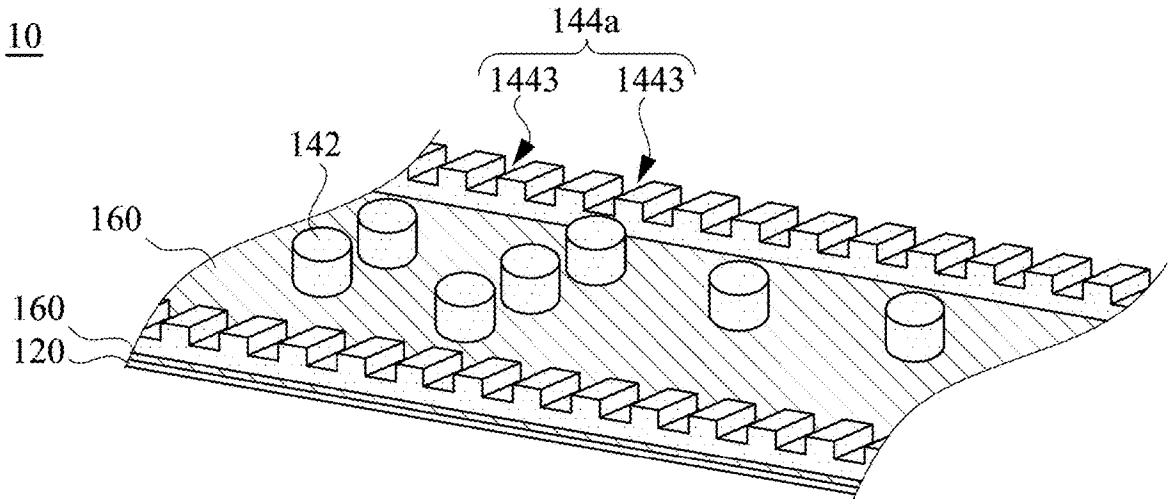
FIGS. 6A, 6B, 6C, 6D, 6E, 6F, 6G, and 6H are schematic diagrams of a portion of a vapor chamber according to various embodiments of the present disclosure.
Figure 6B:
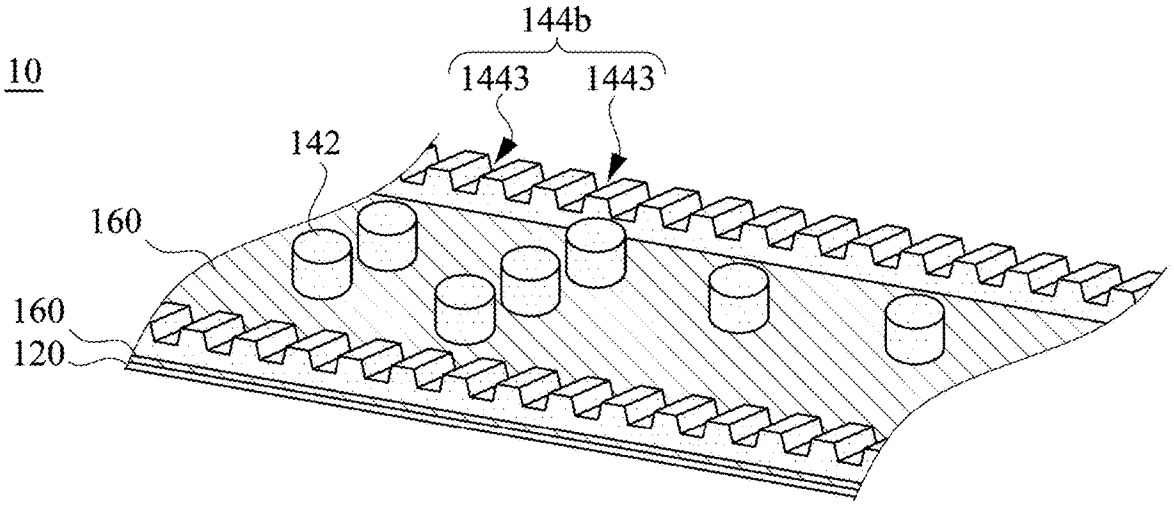
Figure 6C:
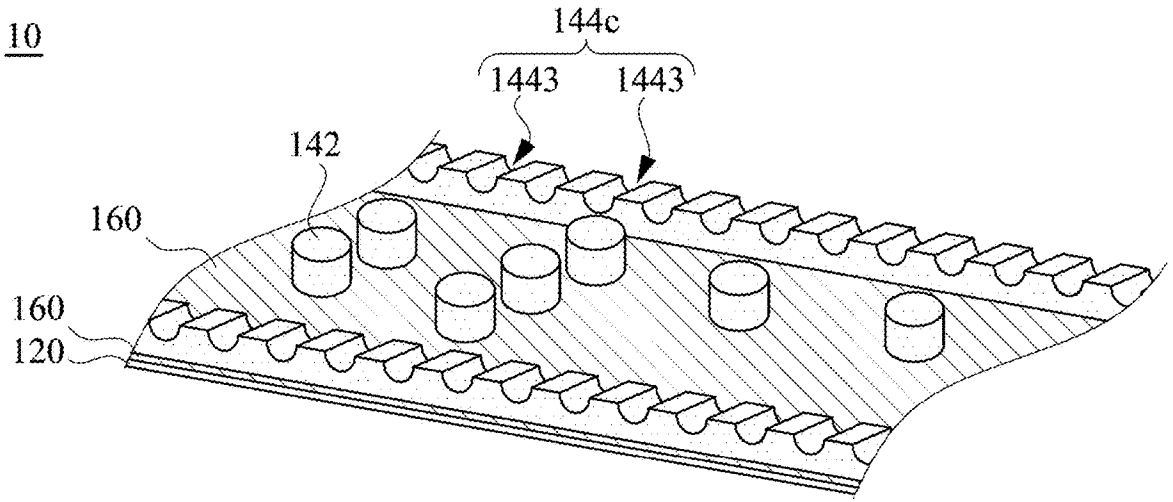
Figure 6D:
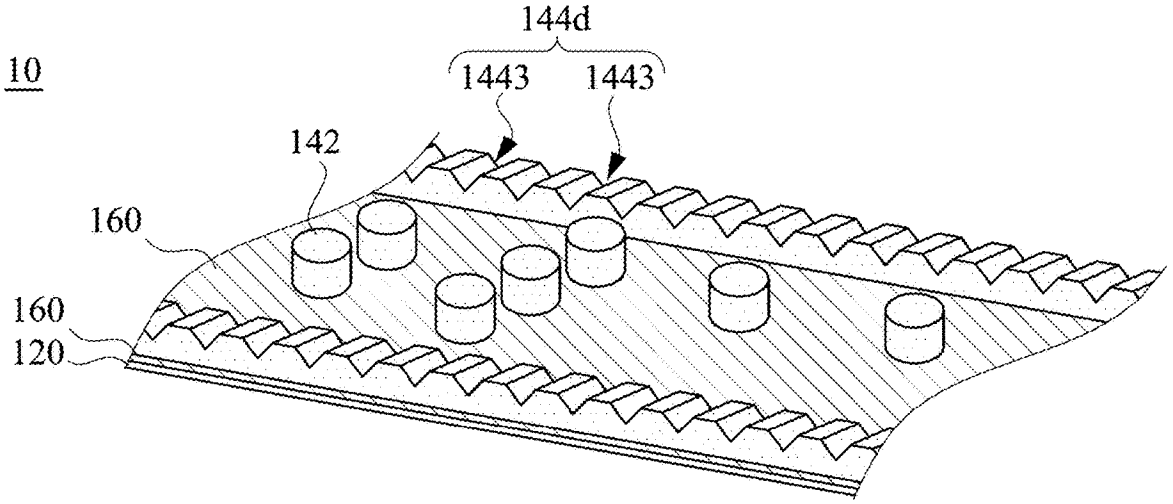

Other features of the strip 144 in the capillary structure 140 of the present disclosure will be described next. FIGS. 6A, 6B, 6C, and 6D are schematic diagrams of a portion of a vapor chamber according to various embodiments of the present disclosure. In some embodiments, a cross-sectional profile of each first groove 1443 is a polygon, or each first groove has a curved surface. For example, the cross-sectional profile of the first groove 1443 of the strip 144*a* of the internal capillary structure of the vapor chamber 10 may be rectangular or square, as shown in FIG. 6A. For another example, the cross-sectional profile of the first groove 1443 of the strip 144*b* of the internal capillary structure of the vapor chamber 10 may be trapezoid, as shown in FIG. 6B. For another example, the cross-sectional profile of the first groove 1443 of the strip 144*c* of the internal capillary structure of the vapor chamber 10 has a curved surface, as shown in FIG. 6C. For another example, the cross-sectional profile of the first groove 1443 of the strip 144*d* of the internal capillary structure of the vapor chamber 10 may be triangle, as shown in FIG. 6D. It can be understood that the cross-sectional profile of the first groove 1443 may be other irregular shapes. In addition to improving the air conduction capacity of the vapor chamber, this design also has the effect of guiding condensed water from the remote end to the heat source end.

Figure 6E:
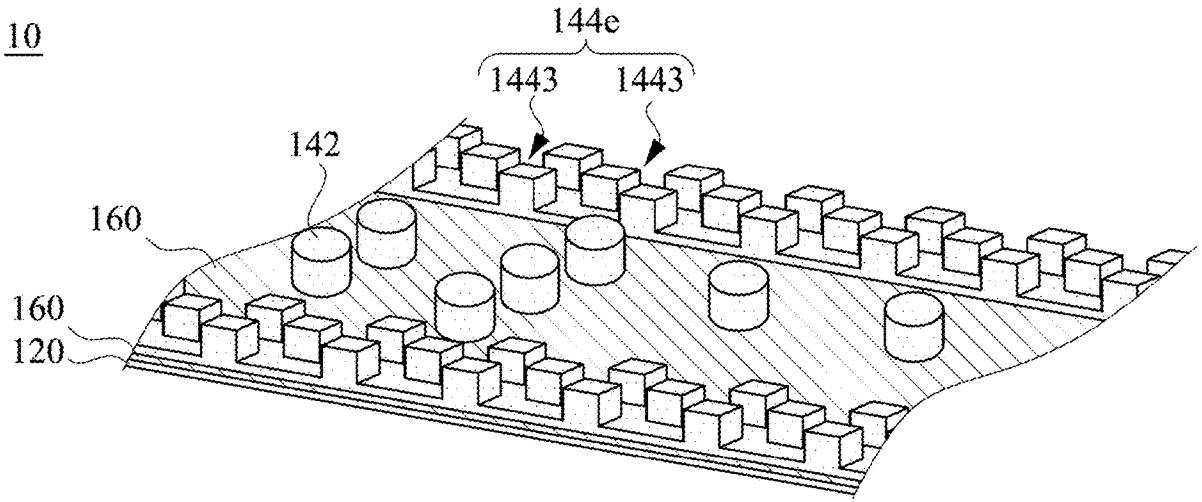

FIG. 6E is a schematic diagram of a portion of a vapor chamber according to another embodiment of the present disclosure. In some embodiments, the first grooves 1443 of the strip 144*e* of the internal capillary structure of the vapor chamber 10 communicate with each other, as shown in FIG. 6E.

Figure 6F:
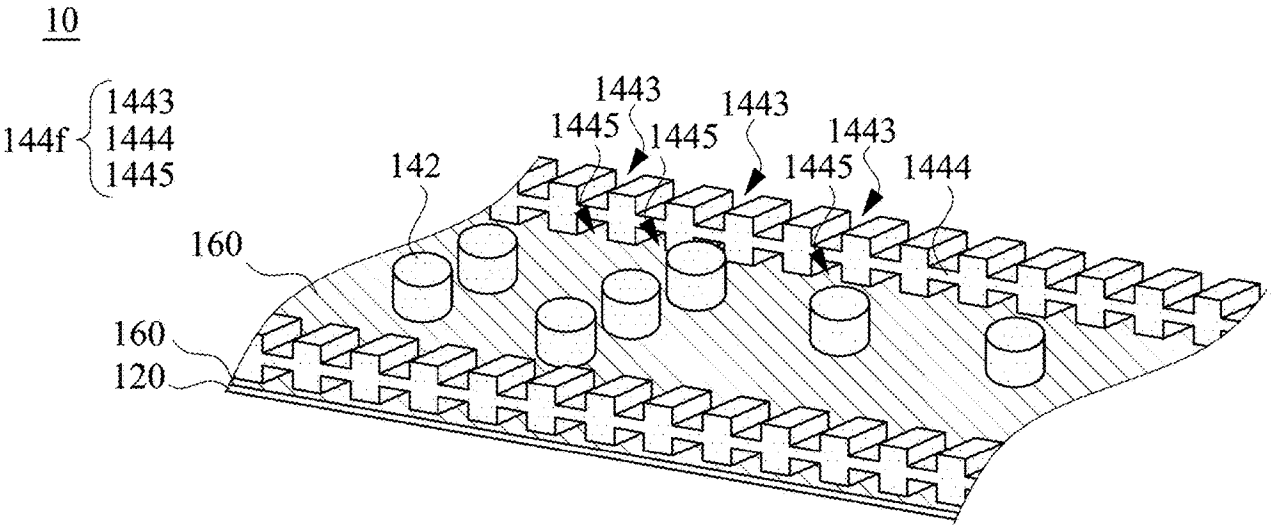
Figure 6G:
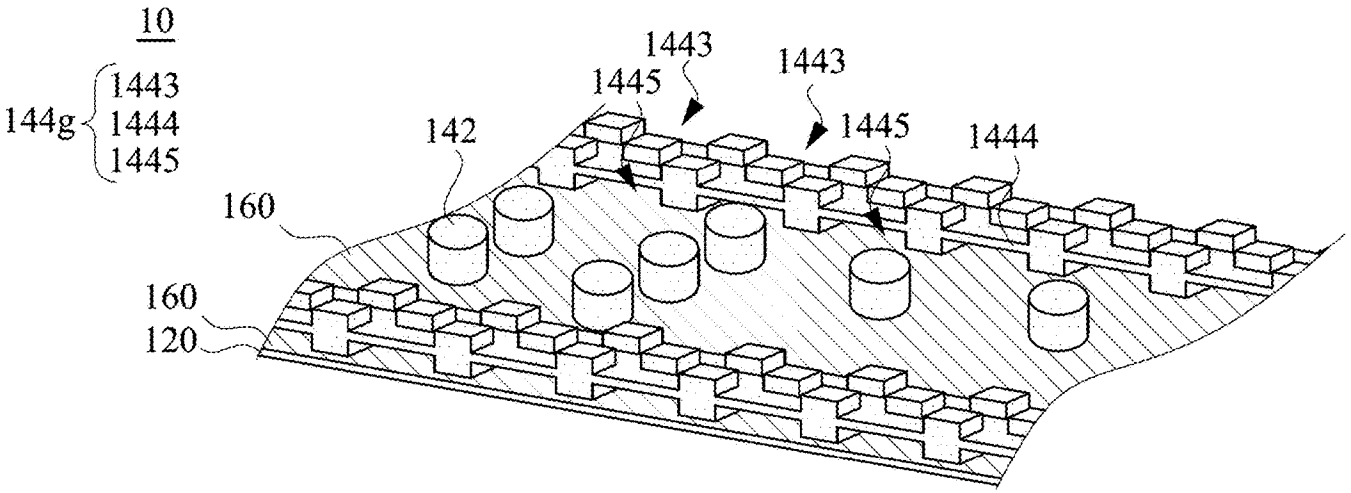
Figure 6H:
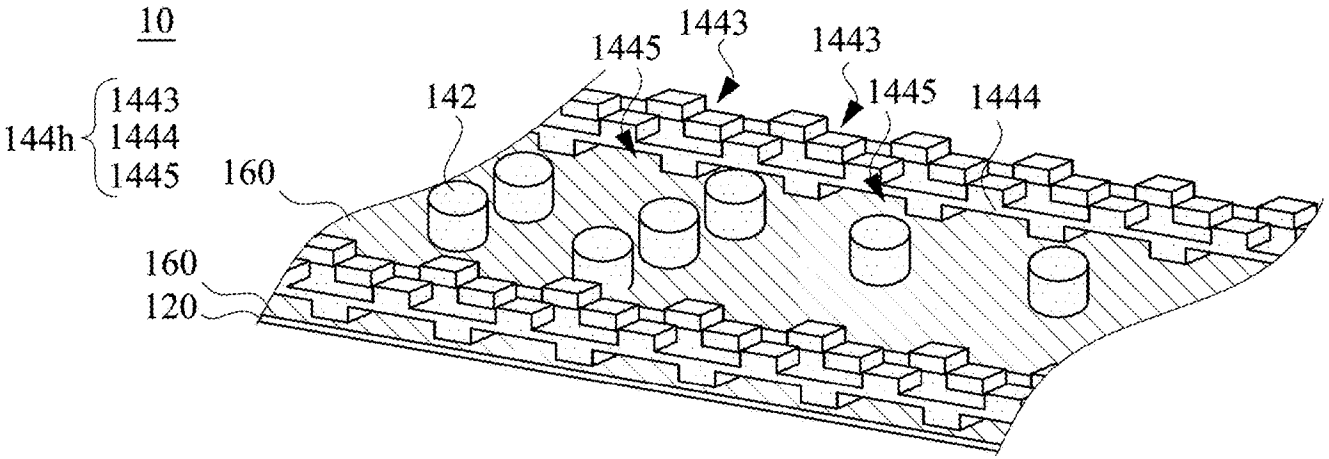

FIGS. 6F, 6G, and 6H are schematic diagrams of a portion of a vapor chamber according to other embodiments of the present disclosure. In some embodiments, the strip 144*f* of the internal capillary structure of the vapor chamber 10 further has a plurality of second grooves 1445 that are recessed from the second surface 1442 toward the first surface 1441, as shown in FIG. 6F to FIG. 6H. That is to say, the strip 144*f* simultaneously has a plurality of first grooves 1443 recessed from the first surface 1441 toward the second surface 1442 and a plurality of second grooves 1445 recessed from the second surface 1442 toward the first surface 1441, and a continuous portion 1444 is between the first groove 1443 and the second groove 1445. In other words, the strip 144*f* includes the continuous portion 1444, a plurality of protrusions toward the first plate body 110, and a plurality of protrusions toward the second plate body 120. In can be understood that the cross-section profile of each first groove 1443 and each second groove 1445 may be independently polygonal or each second groove has a curved profile, in which the cross-sectional profile may be rectangular, square, trapezoidal, triangular or other irregular shapes. In the embodiment where the strip has a plurality of second grooves 1445, the first grooves 1443 of the strip 144*f* are symmetrically arranged with the second grooves 1445, as shown in FIG. 6F. In other words, the cross-sectional profile and the position of each first groove 1443 may correspond to the cross-sectional profile and the position of each second groove 1445. In other alternative embodiments, the first grooves 1443 of the strip 144*f* may also be arranged asymmetrically with the second grooves 1445 (not shown). In other words, the cross-sectional profile and the position of each first groove 1443 may not correspond to the cross-sectional profile and the position of each second groove 1445. In some embodiments, these second grooves 1445 may be formed on the strip 144 by etching, laser, stamping, or other suitable processes.

In the embodiment where the strip has a plurality of second grooves 1445, these second grooves 1445 communicate with each other, and the first grooves 1443 and the second grooves 1445 are arranged opposite to each other on the continuous portion 1444. As shown in FIG. 6G, the first grooves 1443 of the strip 144*g* of the internal capillary structure of the vapor chamber 10 communicate with each other, the second grooves 1445 of the strip 144*g* also communicate with each other, and the first grooves 1443 are disposed symmetrically with the second grooves 1445 on the continuous portion 1444. As shown in FIG. 6H, the first grooves 1443 of the strip 144*h* of the internal capillary structure of the vapor chamber 10 communicate with each other, the second grooves 1445 of the strip 144*h* also communicate with each other, and the first grooves 1443 are disposed asymmetrically with the second grooves 1445 on the continuous portion 1444.

The design of the vapor chamber 10 in FIG. 6F and FIG. 6H is particularly suitable for situations where there are heat sources above and below the first plate body 110 and the second plate body 120 of the vapor chamber 10. That is to say, when there are heat sources above and below the first plate body 110 and the second plate body 120 of the vapor chamber 10, the strip 144 in the capillary structure 140 has the first grooves 1443 and the second grooves 1445 on opposite sides of the continuous portion 1444, which has a better heat dissipation effect. More specifically, when both the first plate body 110 and the second plate body 120 of the vapor chamber 10 are in contact with the heat source, the condensed water at the end far away from the heat source will be guided horizontally from the continuous portion 1444 to a position close to the heat source through capillary action through the protruding portions on both sides of the first groove 1443 and/or the second groove 1445. In addition to improving the air conduction capacity of the vapor chamber, this design also improves the efficiency of condensation water flow from the remote end to the heat source end.

Figure 7A:
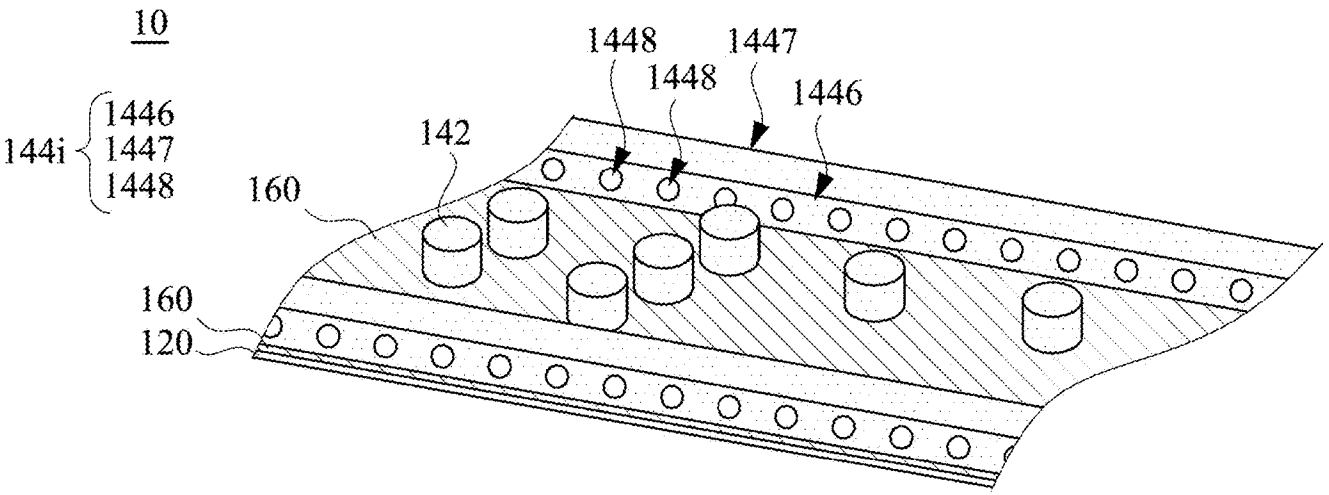
FIGS. 7A, 8A, and 9A are schematic diagrams of a portion of a vapor chamber according to other embodiments of the present disclosure.
Figure 7B:
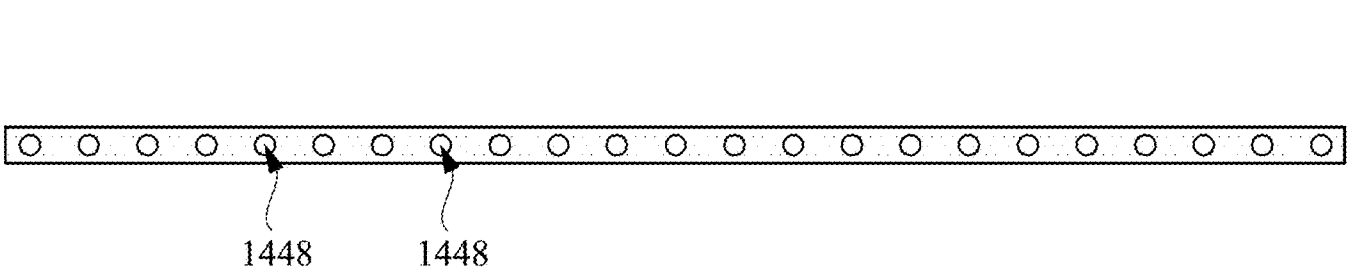
FIGS. 7B, 8B, and 9B are side views of the strip in FIGS. 7A, 8A, and 9A respectively.
Figure 8A:
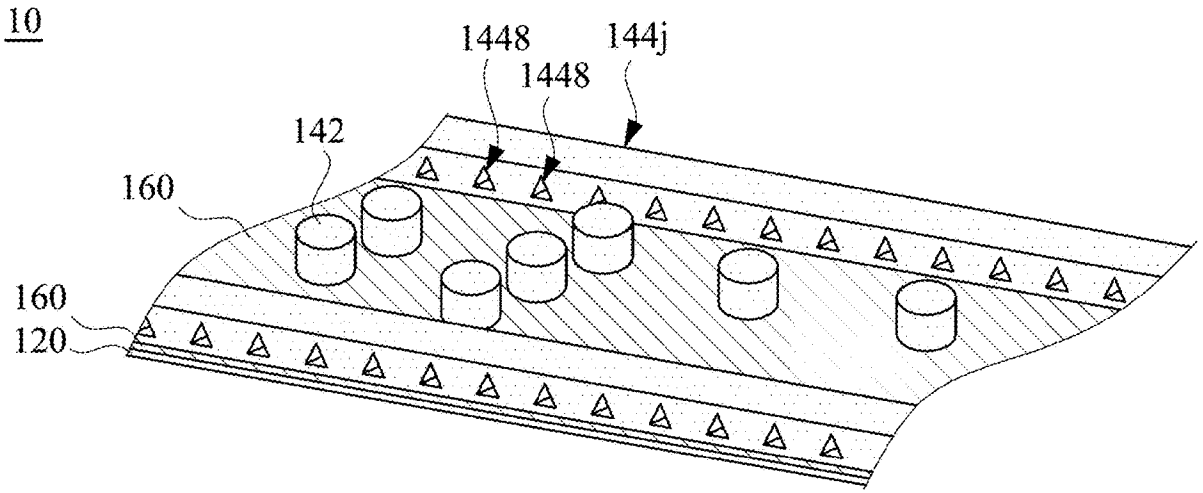
Figure 8B:
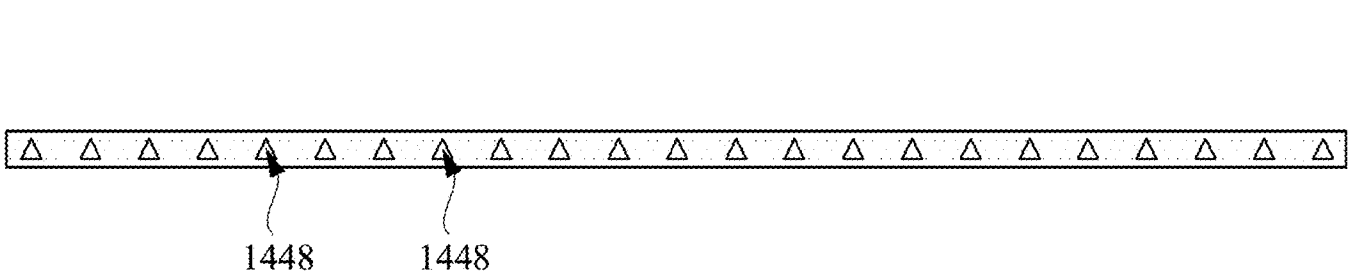
Figure 9A:
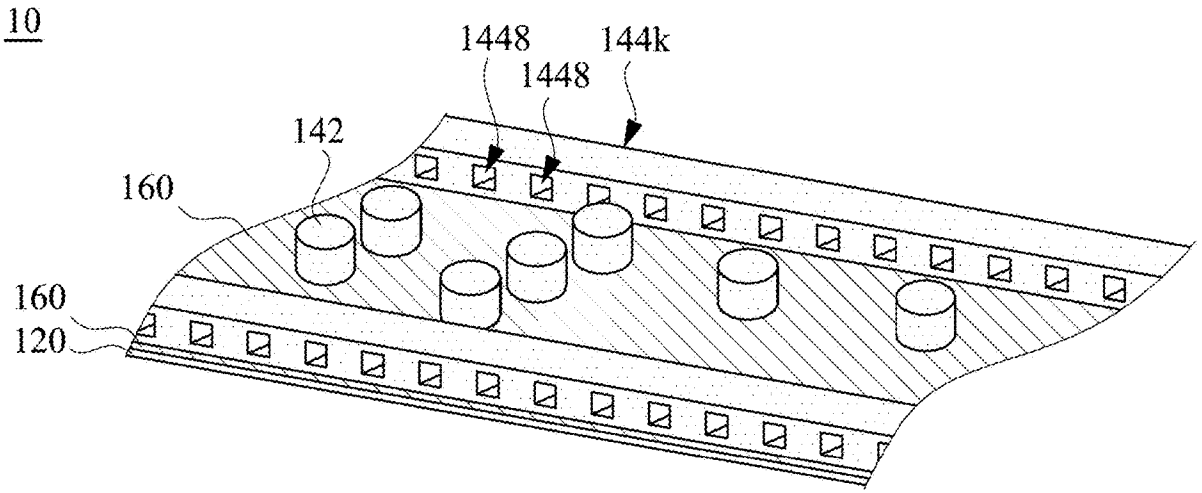
Figure 9B:
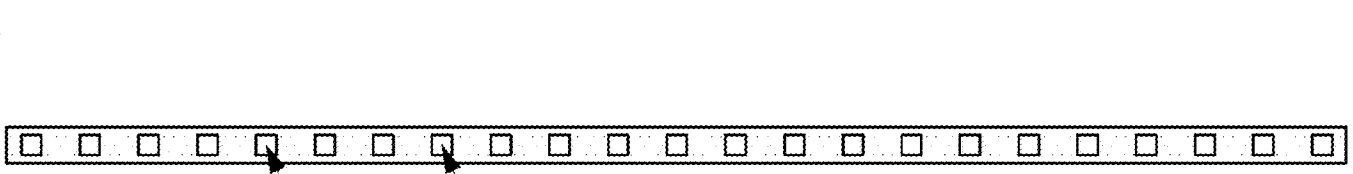

FIGS. 7A, 8A, and 9A are schematic diagrams of a portion of a vapor chamber according to other embodiments of the present disclosure. FIGS. 7B, 8B, and 9B are side views of the strip in FIGS. 7A, 8A, and 9A respectively. In another embodiment, the strip has an opposite first side surface 1446 and a second side surface 1447, the first side surface 1446 and the second side surface 1447 respectively extend along a long side of the strip, and the strip has a plurality of holes 1448 penetrating from the first side surface 1446 to the second side surface 1447. In various embodiments, a cross-sectional profile of the holes 1448 is a circle, a polygon, or an irregular profile.

As shown in FIG. 7A and FIG. 7B, the cross-sectional profile of the holes 1448 of the strip 144*i* of the internal capillary structure of the vapor chamber 10 is circular. As shown in FIG. 8A and FIG. 8B, the cross-sectional profile of the holes 1448 of the strip 144*j* of the internal capillary structure of the vapor chamber 10 is triangle. As shown in FIG. 9A and FIG. 9B, the cross-sectional profile of the holes 1448 of the strip 144*k* of the internal capillary structure of the vapor chamber 10 is square. However, the disclosure is not limited thereto. The cross-sectional shape of the holes 1448 of the strip may also be rectangular, trapezoidal, elliptical or other irregular shapes.

It can be understood that when the first plate body 110 and/or the second plate body 120 of the vapor chamber 10 contacts a heat source, the condensed water at the end far away from the heat source will be guided horizontally from the first thin capillary layer 150 to a position close to the heat source through capillary action, and then the flow is directed vertically to the capillary structure 140 for heat dissipation.

Given above, the vapor chamber disclosed in the present disclosure processes the strip in the capillary structure so that the strip has a multiple grooves design. These grooves provide more lateral flow paths for vapor, thereby reducing the resistance to vapor transfer inside the cavity, improving the degassing efficiency of the vacuum process, and reducing residual non-condensable gas (NCG). In addition, this design may also improve the internal vapor flow circulation efficiency when the vapor chamber is in use, thereby increasing the heat exchange efficiency of the vapor chamber.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A vapor chamber, comprising:

a first plate body;

a second plate body disposed below the first plate body, wherein the first plate body and the second plate body form a closed cavity;

a capillary structure disposed within the closed cavity, the capillary structure comprising at least one column and at least one strip, wherein the at least one strip has an opposite first surface and a second surface, the first surface faces the first plate body or the second plate body, the at least one strip has a plurality of first grooves that are recessed from the first surface toward the second surface, and the at least one strip has a first protrusion portion and a second protrusion portion, wherein the first protrusion portion and the second protrusion portion are protruded toward the first plate body, and the first protrusion portion comprises one first protrusion, and the second protrusion portion comprises two second protrusions, and wherein the first protrusion portion and the second protrusion portion are alternately disposed along a long side of the at least one strip, and the two second protrusions are spaced apart and aligned with each other along a short side perpendicular to the long side of the at least one strip; and a first thin capillary layer disposed between the second plate body and the capillary structure.

2. The vapor chamber of claim 1, wherein a cross-sectional profile of each first groove is a polygon, or each first groove has a curved surface.

3. The vapor chamber of claim 1, wherein the first grooves communicate with each other.

4. The vapor chamber of claim 1, wherein the at least one strip has a plurality of second grooves that are recessed from the second surface toward the first surface.

5. The vapor chamber of claim 4, wherein the second grooves communicate with each other.

6. The vapor chamber of claim 4, wherein a cross-sectional profile of each second groove is a polygon, or each second groove has a curved surface.

7. The vapor chamber of claim 4, wherein the first grooves are substantially symmetrically arranged with the second grooves.

8. The vapor chamber of claim 1, further comprising a second thin capillary layer disposed between the first plate body and the capillary structure.

9. The vapor chamber of claim 1, wherein the first plate body has a third surface toward the capillary structure, and the third surface has a capillary feature.

10. The vapor chamber of claim 1, wherein the second plate body has a fourth surface toward the capillary structure, and the fourth surface has a capillary feature.

11. The vapor chamber of claim 1, wherein the first protrusion is spaced apart from each of the two second protrusions.

12. The vapor chamber of claim 1, wherein the at least one strip further has a third protrusion portion and a fourth protrusion portion, the third protrusion portion and the fourth protrusion portion are protruded toward the second plate body, the third protrusion portion comprises one third protrusion, and the fourth protrusion portion comprises two fourth protrusions, and wherein the third protrusion portion and the fourth protrusion portion are alternately disposed along the long side of the at least one strip, and the two fourth protrusions are spaced apart and aligned with each other along the short side of the at least one strip.

13. The vapor chamber of claim 12, wherein the third protrusion is spaced apart from each of the two fourth protrusions.

14. The vapor chamber of claim 12, wherein the first protrusion portion and the second protrusion portion are substantially symmetrically arranged with the third protrusion portion and the fourth protrusion portion, respectively.

15. A vapor chamber, comprising:

a first plate body;

a second plate body disposed below the first plate body, wherein the first plate body and the second plate body form a closed cavity;

a capillary structure disposed within the closed cavity, the capillary structure comprising a plurality of columns and two strips, and the columns are disposed between the two strips, wherein each of the two strips has an opposite first side surface and a second side surface, and has an opposite first surface and a second surface, wherein the first surface faces the first plate body or the second plate body, and the first side surface and the second side surface connect the first surface and the second surface, wherein the first side surface and the second side surface respectively extend along a long side of each of the two strips, and each of the two strips has a plurality of holes penetrating from the first side surface to the second side surface, and wherein the holes are surrounding by the first surface and the second surface; and a first thin capillary layer disposed between the second plate body and the capillary structure.

16. The vapor chamber of claim 15, wherein a cross-sectional profile of the holes is a circle, a polygon, or an irregular profile.

17. The vapor chamber of claim 15, further comprising a second thin capillary layer disposed between the first plate body and the capillary structure.

18. The vapor chamber of claim 15, wherein the first plate body has a first surface toward the capillary structure, and the first surface has a capillary feature.

19. The vapor chamber of claim 15, wherein the second plate body has a second surface toward the capillary structure, and the second surface has a capillary feature.

* * * * *